US007824311B1

(12) United States Patent
Hsu

(10) Patent No.: US 7,824,311 B1
(45) Date of Patent: Nov. 2, 2010

(54) EXERCISING HANDGRIP HAVING ADJUSTABLE DAMPING FORCE

(76) Inventor: Kuang-Chien Hsu, 146, Jiadian Rd., Chenping Li, Hemei Township, Changhua County (TW)

( * ) Notice: Subject to any disclaimer, the term of this patent is extended or adjusted under 35 U.S.C. 154(b) by 0 days.

(21) Appl. No.: 12/702,515

(22) Filed: Feb. 9, 2010

(51) Int. Cl.
*A63B 21/00* (2006.01)

(52) U.S. Cl. ..... 482/49; 482/126

(58) Field of Classification Search ..... 482/49, 482/126, 121, 127, 62, 41, 44; 602/40
See application file for complete search history.

(56) References Cited

U.S. PATENT DOCUMENTS 2,529,347 A * 11/1950 Ross, Jr. et al. ..... 482/126
4,629,186 A * 12/1986 Aldridge ..... 482/126
6,319,175 B1 * 11/2001 Wu ..... 482/49

* cited by examiner

*Primary Examiner*—Jerome Donnelly
(74) *Attorney, Agent, or Firm*—Alan Kamrath; Kamrath & Associates PA

(57) ABSTRACT

An exercising handgrip includes a first handle, a second handle pivotally connected with the first handle, a damping spring biased between the first handle and the second handle, a threaded adjusting module movably mounted on the second handle and pressing the damping spring, and a threaded adjusting knob rotatably mounted on the second handle and screwed onto the threaded adjusting module to move the threaded adjusting module relative to the damping spring by rotation of the adjusting knob. Thus, the adjusting knob is rotated on the second handle to drive the threaded adjusting module to move forward or backward relative to the second handle so as to change the distance between the first handle and the second handle and to compress or extend the damping spring, thereby adjusting the damping force of the damping spring.

2 Claims, 4 Drawing Sheets

EXERCISING HANDGRIP HAVING ADJUSTABLE DAMPING FORCE

BACKGROUND OF THE INVENTION

1. Field of the Invention

The present invention relates to an exercising device and, more particularly, to an exercising handgrip.

2. Description of the Related Art

A conventional exercising handgrip comprises a torsion spring having two protruding ends and two handles mounted on the two protruding ends of the torsion spring. In operation, when a user's one hand holds and applies a force on the two handles to compress the torsion spring, the two handles are pressed toward each other, and when the force applied on the two handles us released, the two handles are pulled outward relative to each other by the restoring force of the torsion spring. Thus, the user has to apply a larger force to overcome the elastic force of the torsion spring so as to achieve an exercising effect of training the user's hands. However, the damping force of the torsion spring is fixed and cannot be adjusted freely according to the user's requirement so that when the user wishes to change the damping force of the torsion spring, he/she needs to prepare exercising handgrips of different damping forces, thereby increasing the costs and causing inconvenience in storage of the exercising handgrips.

BRIEF SUMMARY OF THE INVENTION

In accordance with the present invention, there is provided an exercising handgrip, comprising a first handle, a second handle pivotally connected with the first handle, a damping spring biased between the first handle and the second handle, a threaded adjusting module movably mounted on the second handle and pressing the damping spring, and a threaded adjusting knob rotatably mounted on the second handle and screwed onto the threaded adjusting module to move the threaded adjusting module relative to the damping spring by rotation of the adjusting knob.

The primary objective of the present invention is to provide an exercising handgrip having an adjustable damping force.

According to the primary objective of the present invention, the adjusting knob is rotated on the second handle to drive the threaded adjusting module to move forward or backward relative to the second handle so as to change the distance between the first handle and the second handle and to compress or extend the damping spring between the first handle and the second handle, thereby adjusting the damping force of the damping spring.

According to another objective of the present invention, the damping force of the damping spring can be adjusted freely so that the user only has to purchase a single exercising handgrip and needs not to prepare exercising handgrips of different damping forces, thereby saving the cost, and thereby facilitating storage of the exercising handgrip.

According to a further objective of the present invention, the exercising handgrip has a simplified construction and is assembled easily and quickly, thereby saving the cost of assembly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
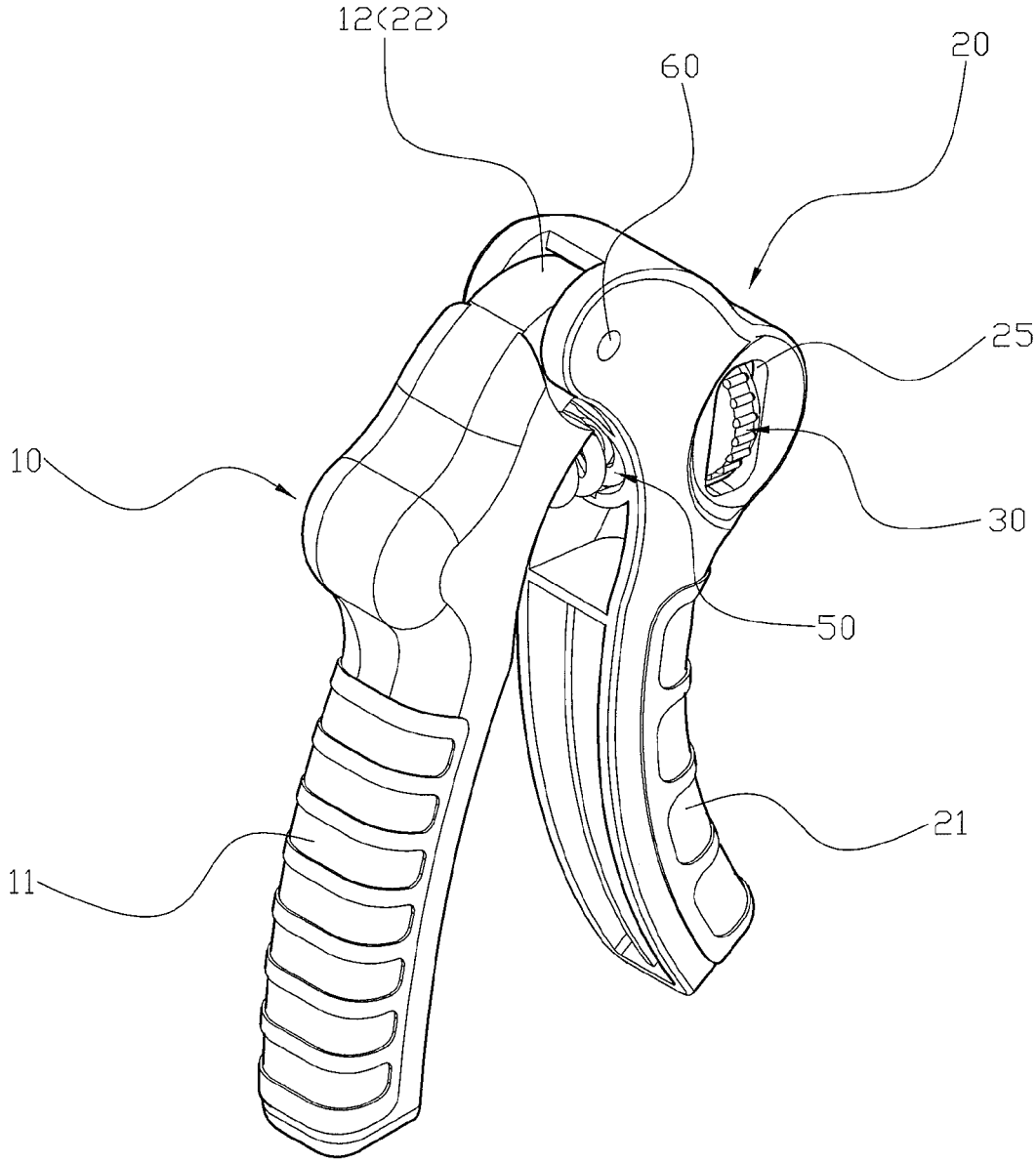
FIG. 1 is a perspective view of an exercising handgrip in accordance with the preferred embodiment of the present invention.
Figure 2:
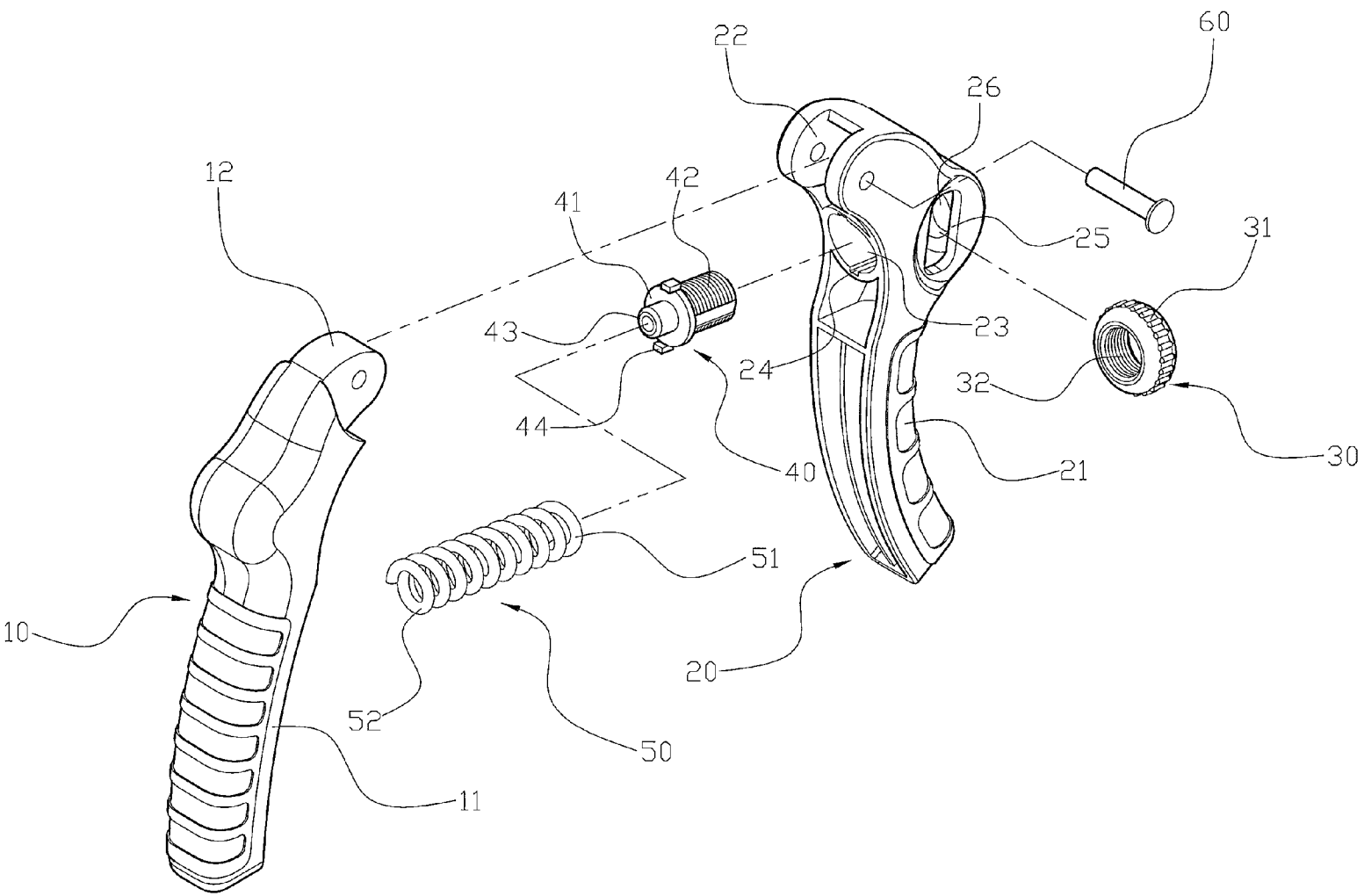
FIG. 2 is an exploded perspective view of the exercising handgrip as shown in FIG. 1.
Figure 3:
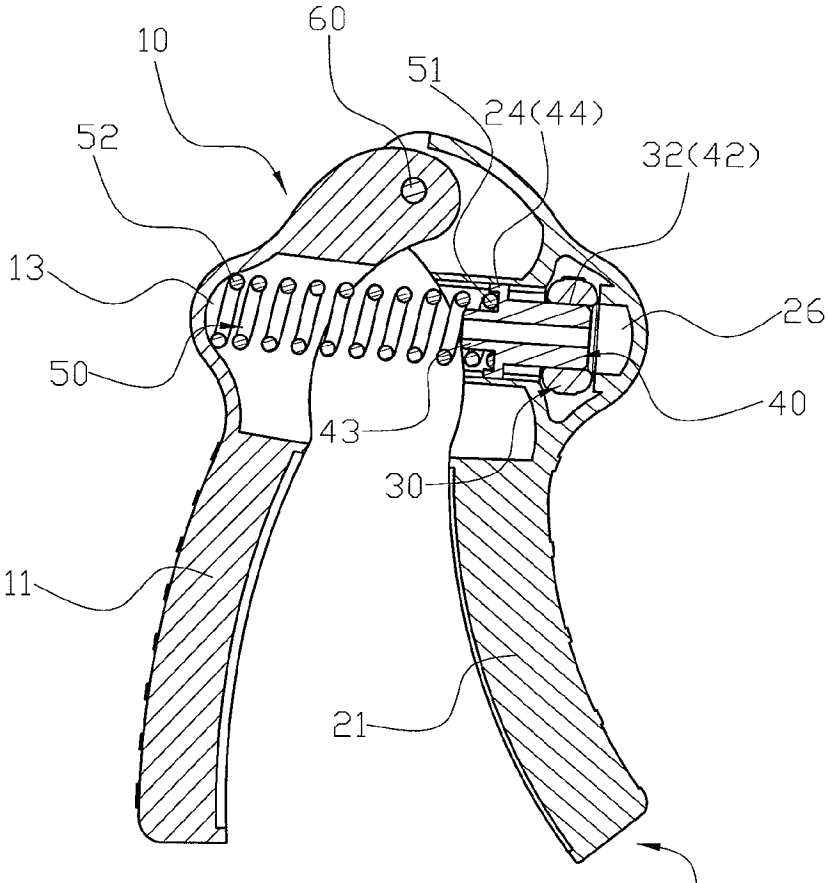
FIG. 3 is a front cross-sectional view of the exercising handgrip as shown in FIG. 1.

Referring to the drawings and initially to FIGS. 1-3, an exercising handgrip in accordance with the preferred embodiment of the present invention comprises a first handle 10, a second handle 20 pivotally connected with the first handle 10, a damping spring 50 biased between the first handle 10 and the second handle 20, a threaded adjusting module 40 movably mounted on the second handle 20 and pressing the damping spring 50, and a threaded adjusting knob 30 rotatably mounted on the second handle 20 and screwed onto the threaded adjusting module 40 to move the threaded adjusting module 40 relative to the damping spring 50 by rotation of the adjusting knob 30.

The first handle 10 has an upper end provided with a first pivot portion 12 and a lower end provided with a first holding portion 11. The first handle 10 has an inner face provided with a receiving chamber 13 located between the first pivot portion 12 and the first holding portion 11 of the first handle 10.

The second handle 20 has an upper end provided with a second pivot portion 22 pivotally connected with the first pivot portion 12 of the first handle 10 by a pivot shaft 60 and a lower end provided with a second holding portion 21. The second handle 20 has an inner face provided with a slideway 23 located between the second pivot portion 22 and the second holding portion 21 of the second handle 20. The slideway 23 of the second handle 20 has a periphery having two opposite sides each provided with a first limit portion 24. The second handle 20 has an inner portion provided with a receiving groove 26 facing the slideway 23 of the second handle 20. The second handle 20 has two opposite sides each provided with a mounting hole 25 connected to the slideway 23 and the receiving groove 26 of the second handle 20. The mounting hole 25 of the second handle 20 is located between the slideway 23 and the receiving groove 26 of the second handle 20.

The threaded adjusting module 40 is movably mounted in the slideway 23 of the second handle 20 and is extendable into the receiving groove 26 of the second handle 20. The threaded adjusting module 40 includes a base plate 41 movable in the slideway 23 of the second handle 20, a threaded rod 42 mounted on a first side of the base plate 41 and extendable into the receiving groove 26 of the second handle 20, and a mounting post 43 mounted on a second side of the base plate 41 and facing the receiving chamber 13 of the first handle 10. The base plate 41 of the threaded adjusting module 40 has a periphery having two opposite sides each provided with a second limit portion 44 slidable on and limited by the first limit portion 24 of the second handle 20 so that the threaded adjusting module 40 is movable axially relative to the second handle 20 and is non-rotatable relative to the second handle 20.

The damping spring 50 has a first end 51 extended into the slideway 23 of the second handle 20 and mounted on the mounting post 43 of the threaded adjusting module 40 and a second end 52 extended into the receiving chamber 13 of the first handle 10 and abutting the first handle 10. The first end 51 of the damping spring 50 abuts the base plate 41 of the threaded adjusting module 40.

The adjusting knob 30 is rotatably mounted in the mounting holes 25 of the two opposite sides of the second handle 20 and is disposed between the slideway 23 and the receiving groove 26 of the second handle 20. The adjusting knob 30 has an inner wall provided with an inner threaded portion 32 screwed onto the threaded rod 42 of the threaded adjusting module 40. The adjusting knob 30 has an outer wall provided with a serrated operation portion 31 to facilitate a user rotate the adjusting knob 30. When in use, the threaded adjusting module 40 is movable axially relative to the second handle 20 and is non-rotatable relative to the second handle 20, so that when the adjusting knob 30 is rotated in the mounting holes 25 of the two opposite sides of the second handle 20, the threaded adjusting module 40 is driven by the adjusting knob 30 to move forward or backward relative to the second handle 20 so as to compress or extend the damping spring 50.

In the preferred embodiment of the present invention, the first limit portion 24 of the second handle 20 is an elongate guide slot, and the second limit portion 44 of the threaded adjusting module 40 is an elongate guide block slidable in the guide slot.

Figure 4:
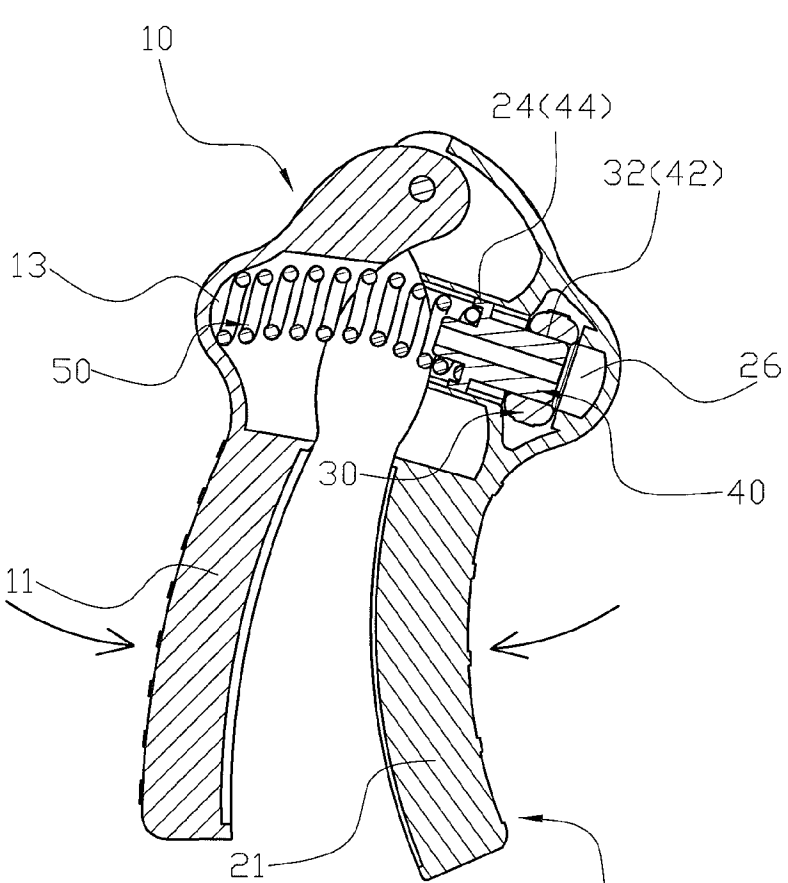
FIG. 4 is a schematic operational view of the exercising handgrip as shown in FIG. 3 in use.

In operation, referring to FIGS. 3 and 4 with reference to FIGS. 1 and 2, when a user's one hand holds and applies a force on the first holding portion 11 of the first handle 10 and the second holding portion 21 of the second handle 20, the first holding portion 11 of the first handle 10 and the second holding portion 21 of the second handle 20 are pressed toward each other to compress the damping spring 50. After the force applied on the first holding portion 11 of the first handle 10 and the second holding portion 21 of the second handle 20 is released, the first holding portion 11 of the first handle 10 and the second holding portion 21 of the second handle 20 are pushed outwardly relative to each other by the restoring force of the damping spring 50. In such a manner, the damping spring 50 provides a damping force to resist the force applied by the user's hand so that the user has to apply a larger force to overcome the damping force of the damping spring 50 between the first handle 10 and the second handle 20 so as to move the first holding portion 11 of the first handle 10 and the second holding portion 21 of the second handle 20 toward each other so as to achieve an exercising effect of training the user's hand.

Figure 6:
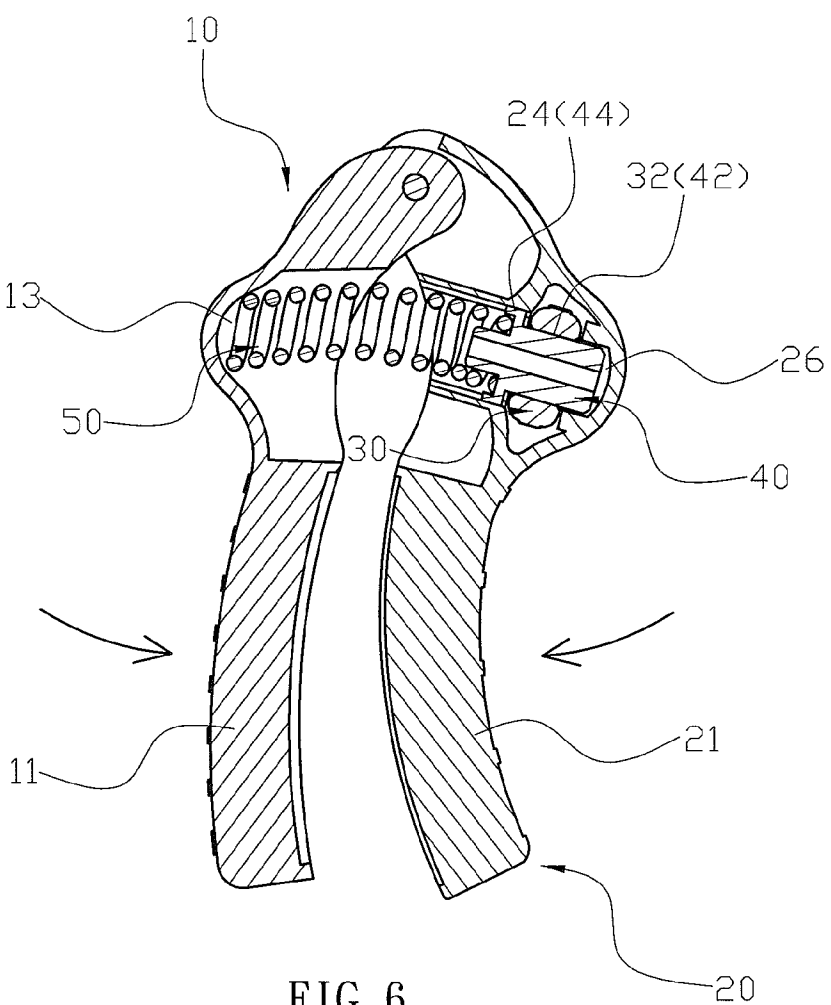
FIG. 6 is a schematic operational view of the exercising handgrip as shown in FIG. 5 in use.
Figure 5:
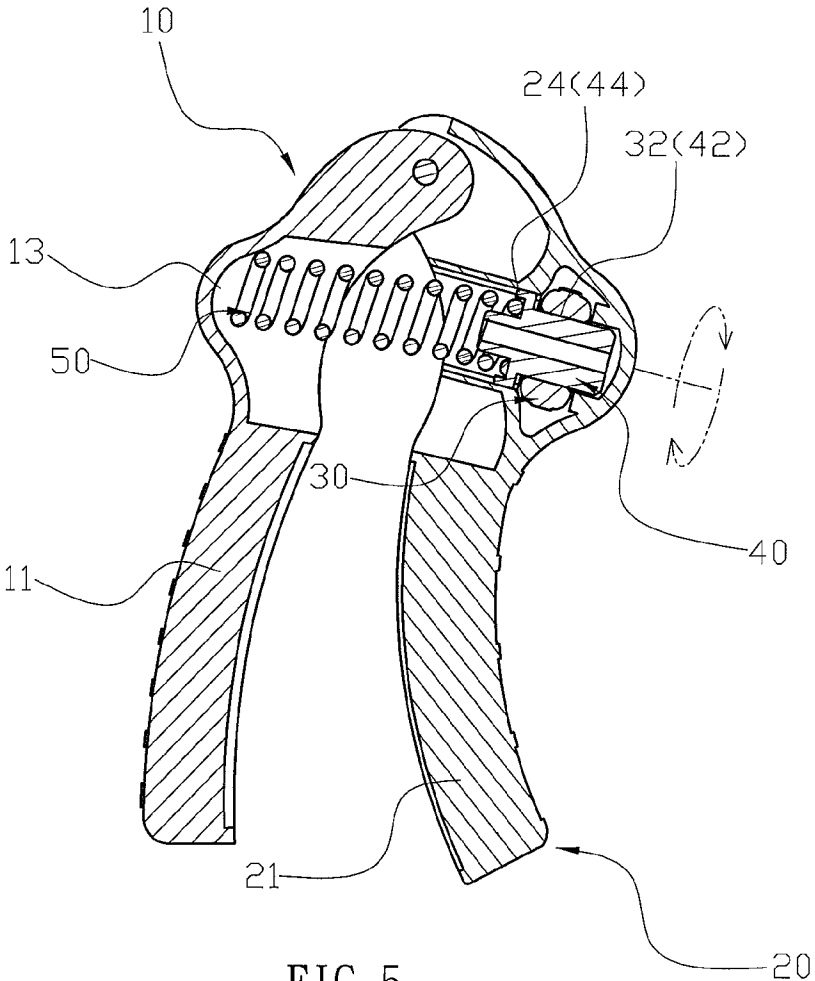
FIG. 5 is a schematic operational view of the exercising handgrip as shown in FIG. 3 in adjustment.

In adjustment, referring to FIGS. 5 and 6 with reference to FIGS. 1-3, when the user wishes to adjust the damping force of the damping spring 50, the adjusting knob 30 is rotated in the mounting holes 25 the second handle 20, so that the threaded adjusting module 40 is driven by the adjusting knob 30 to move forward or backward relative to the second handle 20 and to compress or extend the damping spring 50 so as to adjust the damping force of the damping spring 50. It is to be noted that, when the threaded adjusting module 40 is driven by the adjusting knob 30 to move forward or backward relative to the second handle 20, the distance between the first handle 10 and the second handle 20 is changed. In addition, when the threaded adjusting module 40 is driven by the adjusting knob 30 to move forward relative to the second handle 20, the threaded adjusting module 40 is moved toward the damping spring 50 and is moved to protrude outwardly from the slideway 23 of the second handle 20, and when the threaded adjusting module 40 is driven by the adjusting knob 30 to move backward relative to the second handle 20, the threaded adjusting module 40 is moved outwardly relative to the damping spring 50 and is moved into the receiving groove 26 of the second handle 20.

Accordingly, the adjusting knob 30 is rotated on the second handle 20 to drive the threaded adjusting module 40 to move forward or backward relative to the second handle 20 so as to change the distance between the first handle 10 and the second handle 20 and to compress or extend the damping spring 50 between the first handle 10 and the second handle 20, thereby adjusting the damping force of the damping spring 50. In addition, the damping force of the damping spring 50 can be adjusted freely so that the user only has to purchase a single exercising handgrip and needs not to prepare exercising handgrips of different damping forces, thereby saving the cost, and thereby facilitating storage of the exercising handgrip. Further, the exercising handgrip has a simplified construction and is assembled easily and quickly, thereby saving the cost of assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising handgrip, comprising:

a first handle;

a second handle pivotally connected with the first handle;

a damping spring biased between the first handle and the second handle;

a threaded adjusting module movably mounted on the second handle and pressing the damping spring; and a threaded adjusting knob rotatably mounted on the second handle and screwed onto the threaded adjusting module to move the threaded adjusting module relative to the damping spring by rotation of the adjusting knob;

wherein the first handle has an upper end provided with a first pivot portion and a lower end provided with a first holding portion;

the first handle has an inner face provided with a receiving chamber located between the first pivot portion and the first holding portion of the first handle;

the second handle has an upper end provided with a second pivot portion pivotally connected with the first pivot portion of the first handle by a pivot shaft and a lower end provided with a second holding portion;

the second handle has an inner face provided with a slideway located between the second pivot portion and the second holding portion of the second handle;

the slideway of the second handle has a periphery having two opposite sides each provided with a first limit portion;

the second handle has an inner portion provided with a receiving groove facing the slideway of the second handle;

the second handle has two opposite sides each provided with a mounting hole connected to the slideway and the receiving groove of the second handle;

the mounting hole of the second handle is located between the slideway and the receiving groove of the second handle;

the threaded adjusting module is movably mounted in the slideway of the second handle and is extendable into the receiving groove of the second handle;

the threaded adjusting module includes:

a base plate movable in the slideway of the second handle;

a threaded rod mounted on a first side of the base plate and extendable into the receiving groove of the second handle; and a mounting post mounted on a second side of the base plate and facing the receiving chamber of the first handle;

the base plate of the threaded adjusting module has a periphery having two opposite sides each provided with a second limit portion slidable on and limited by the first limit portion of the second handle so that the threaded adjusting module is movable axially relative to the second handle and is non-rotatable relative to the second handle;

the damping spring has a first end extended into the slideway of the second handle and mounted on the mounting post of the threaded adjusting module and a second end extended into the receiving chamber of the first handle and abutting the first handle;

the first end of the damping spring abuts the base plate of the threaded adjusting module;

the adjusting knob is rotatably mounted in the mounting holes of the two opposite sides of the second handle and is disposed between the slideway and the receiving groove of the second handle;

the adjusting knob has an inner wall provided with an inner threaded portion screwed onto the threaded rod of the threaded adjusting module; and the adjusting knob has an outer wall provided with an operation portion.

2. The exercising handgrip of claim 1, wherein the first limit portion of the second handle is an elongate guide slot; and the second limit portion of the threaded adjusting module is an elongate guide block slidable in the guide slot.

* * * * *